US007024804B2

(12) United States Patent
Levy et al.

(10) Patent No.: US 7,024,804 B2
(45) Date of Patent: Apr. 11, 2006

(54) BOOT MOUNTED BRAKING DEVICE FOR SNOW SLEDS

(76) Inventors: David E. Levy, 1528 - 7th Ave. West, Seattle, WA (US) 98119; Paul Kevin Smith, 12649 - 104th Ave. NE., Kirkland, WA (US) 98034; Lou Patnode, 4619 - 44th Ave. South, Seattle, WA (US) 98118

( * ) Notice: Subject to any disclaimer, the term of this patent is extended or adjusted under 35 U.S.C. 154(b) by 0 days.

(21) Appl. No.: 10/713,610

(22) Filed: Nov. 13, 2003

(65) Prior Publication Data

US 2005/0102864 A1 May 19, 2005

(51) Int. Cl.
*A43B 5/04* (2006.01)

(52) U.S. Cl. ..... 36/136; 36/1

(58) Field of Classification Search ..... 36/132, 36/136, 1; 280/11.209, 11.215, 11.216
See application file for complete search history.

(56) References Cited

U.S. PATENT DOCUMENTS

| | | | | | |
|---|---|---|---|---|---|
| 391,738 | A | * | 10/1888 | Cross | 36/1 |
| 664,627 | A | * | 12/1900 | Eberlein | 30/297 |
| 1,164,810 | A | * | 12/1915 | Hammond | 36/1 |
| 2,588,919 | A | * | 3/1952 | Gredell | 36/7.7 |
| 2,779,262 | A | * | 1/1957 | Furr et al. | 172/370 |
| 3,268,209 | A | * | 8/1966 | Humbyrd | 254/120 |
| 4,155,179 | A | * | 5/1979 | Weninger | 36/117.4 |
| 4,291,473 | A | * | 9/1981 | Sartor | 36/132 |
| 4,693,022 | A | * | 9/1987 | Terhune | 36/132 |
| 5,501,561 | A | * | 3/1996 | Wulff | 36/136 |

* cited by examiner

*Primary Examiner*—Ted Kayanaugh
(74) *Attorney, Agent, or Firm*—Christensen O'Connor Johnson Kindness PLLC

(57) ABSTRACT

A braking member attachable to a sledder's boot is provided. The braking member includes a braking surface that is oriented at a specific ranges of angles with respect to the boot. In use, the braking surface engages the snow like an anchor as the sledder traverses snow covered terrain, thereby producing a braking force against sled forward movement. In one embodiment, the braking member is rotatably attached to the boot and is moveable between a first, walking position, and a second, braking position. In another embodiment, the braking member is fixed in the braking position.

19 Claims, 5 Drawing Sheets

BOOT MOUNTED BRAKING DEVICE FOR SNOW SLEDS

FIELD OF THE INVENTION

The present invention relates generally to braking devices, and, more particularly, to braking devices for recreational equipment, such as snow sleds.

BACKGROUND OF THE INVENTION

Recreational snow sledding has been popular for over 100 years. With the advent of more maneuverable sleds, made of stronger materials, capable of attaining greater speeds while safely descending ski hills, there is a need for providing a method of reducing the speed of the sled or braking when traversing a surface.

SUMMARY OF THE INVENTION

In accordance with aspects of the present invention, a braking device selectively attachable to a boot of a rider having a sole is provided. The braking device is suitable for use with a surface traversing apparatus on which a rider is mounted in a prone position. The braking device includes a base configured to be selectively attachable to a boot of the rider, and a braking member defining a braking surface. The braking member is coupled to the base in a first position such that a portion of the braking member extends distally past the toe end of the base. The braking surface of the braking member is oriented at a selected acute angle with respect to the sole of the boot when the base is attached thereto.

In accordance with another aspect of the present invention, a sled braking device is provided. The sled braking device includes a boot that has a sole and a braking member that defines a braking surface. The braking member is coupled to the boot in a first position such that a portion of the braking surface extends distally past the toe end of the boot. The braking surface of the braking member is oriented at a selected acute angle with respect to the sole of the boot.

In accordance with still another aspect of the present invention, a braking device for use with a sled is provided. The braking device includes a boot composed of a sole, a braking member having an engagement edge and a braking surface, and means for attaching the braking member to the boot. The engagement edge is positioned forward the toe end of the boot and the braking surface oriented at a selected acute angle with respect to the sole of the boot.

In accordance with yet another aspect of the present invention, a braking device selectively connectable to a rider's boot is provided. The braking device includes a base having a toe end and a heel end, at least one boot securement member attached to the base, and a substantially planar braking surface. A portion of the braking surface is positioned forward of the toe end of the base and at an angle with respect to the boot sole when the boot is attached to the base. The angle formed between the boot soul and the braking surface is between about 35 degrees and about 55 degrees.

In accordance with still another aspect of the present invention, a braking device for selectively slowing the movement of a sled as the sled traverses a snow layer is provided. The braking device includes a boot having a toe end and a heel end. The boot includes a sole that supports the sledder's foot. The braking device also includes a blade having a braking surface. A portion of the braking surface is positioned outwardly of the toe end of the boot and oriented such that an angle of about 35 degrees to about 55 degrees is formed between the braking surface and the sole of the boot. The braking surface contacts the snow layer through selective sledder movement as the sled traverses the snow layer.

In accordance with still yet another aspect of the present invention, a braking device selectively connectable to a sledder's boot is provided. The boot has a sole that defines a plane substantially parallel to the bottom of the sledder's foot when coupled thereto. The braking device includes a frame structure, at least one boot securement member attached to the frame structure, and a braking member rotatably connected to the frame structure. The braking member is movable along a path of travel between at least two positions, one of the positions being a braking position whereby the braking surface is located distal of the frame structure and is oriented at an angle of approximately 35 degrees to 55 degrees with respect to the plane of the boot sole when the braking device is connected to the sledder's boot.

BRIEF DESCRIPTION OF THE DRAWINGS

The foregoing aspects and many of the attendant advantages of this invention will become more readily appreciated by reference to the following detailed description, when taken in conjunction with the accompanying drawings, wherein.

DETAILED DESCRIPTION OF THE PREFERRED EMBODIMENT

The present invention will now be described with reference to the accompanying drawings where like numerals correspond to like elements. The present invention is directed to a braking member attached to a sledder's boot for reducing the speed at which a sled or other vehicle traverses a snow covered surface. The braking member may be coupled to the sledder's boot by a variety of attachment methods or may be constructed integrally with the sledder's boot, some of which are shown and described in representative embodiments herein. The term "boot" used herein is meant to encompass all boots, ski boots, snowboard boots, shoes, or other equipment worn on the feet of potential users for protecting and supporting the user's foot, and accordingly, these terms may be used interchangeable. Thus, the following description is meant to be illustrative and not limiting the broadest scope of the invention, as claimed.

Figure 1:
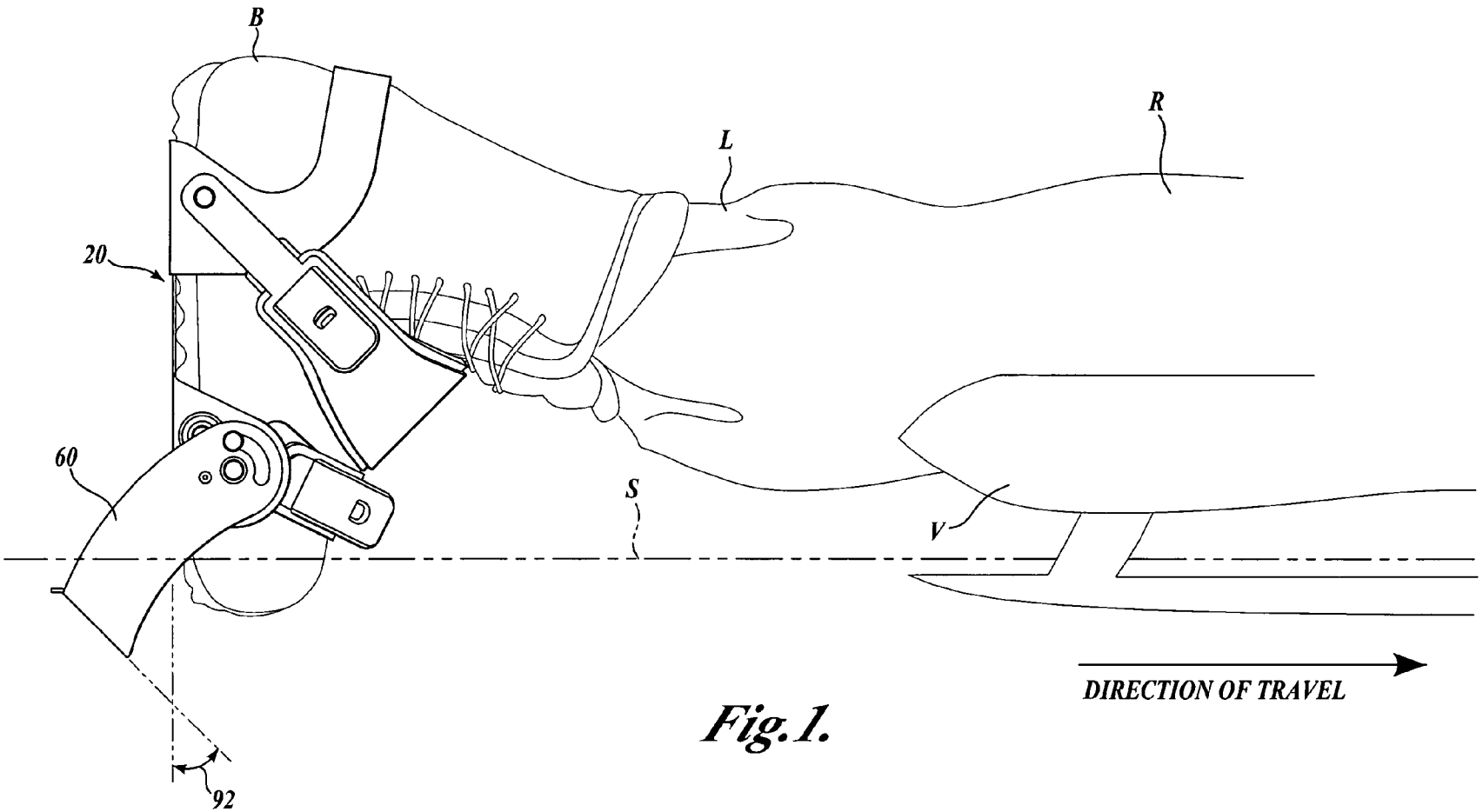
FIG. 1 is a partial side elevation view of a sled on which a sledder is laying prone with braking devices constructed in accordance with one embodiment of the present invention secured to the sledder's boots.

FIG. 1 is a partial side elevation view of a rider or sledder R laying on a sled-like vehicle V (hereinafter "sled V") in the typical riding position, wherein the sledder is in a prone position facing the snow layer S with their legs L trailing the sled V. Generally described, a braking device 20 having a braking member 60 is attached to each of the sledder's boots B for providing a sledder R with the ability to create a braking force against the forward motion of the sled V. In operation, as the sledder R traverses the snow layer S, one or both legs L of the sledder R may be extended substantially parallel to the snow layer S, and/or one or both legs L may be lowered a selected amount towards the snow layer S. Due to the configuration of the braking device 20, the braking member 60 engages the snow layer S at an angle such that a portion of the braking member 60 penetrates or "digs" into the snow like an anchor. As the braking member 60 anchors into the snow layer S, a braking force is produced, thereby slowing or stopping the forward motion of the sled V.

Figure 2:
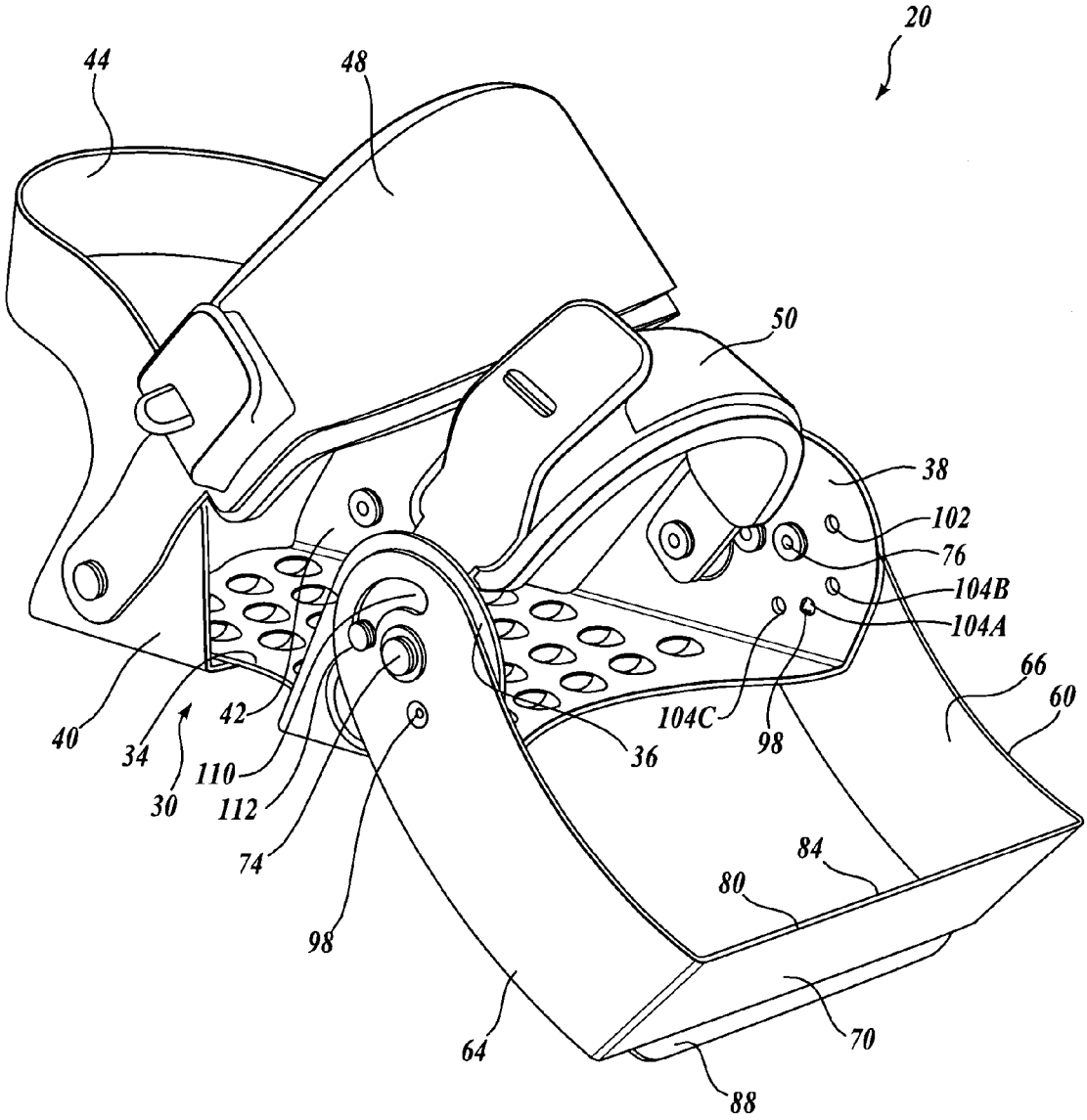
FIG. 2 is a perspective view of the braking device of FIG. 1.
Figure 3:
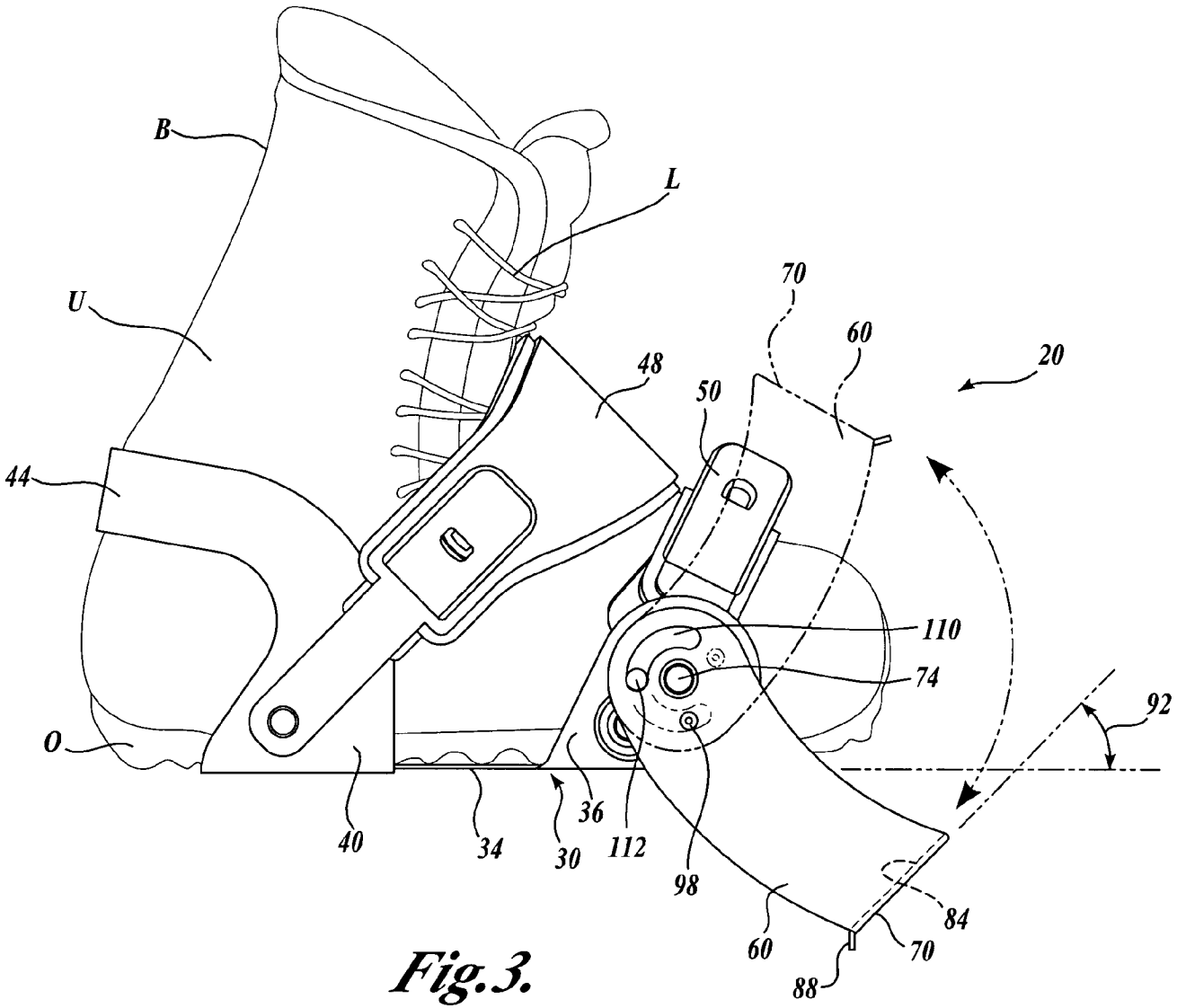
FIG. 3 is a side elevational view of the braking device of FIG. 2 illustrating a braking member moveable between a first, non-braking position, and a second, braking position.

Turning now to FIG. 2, one illustrative embodiment of the braking device 20 formed in accordance with principles of the present invention is shown. The braking device 20 is adapted to be attached to one of the sledder's boots in a removable manner, for example, by a frame 30. The frame 30 may be formed from any suitable rigid material, such as aluminum, titanium, or other metals and alloys, engineering thermoplastics, and fiber reinforced thermoplastics or thermosetting polymers. As best shown in FIG. 2, the frame 30 includes a base plate 34, toe end lateral and medial side walls 36 and 38, heel end lateral and medial side walls 40 and 42, and a heel loop 44. The base plate 34 extends as a base portion of frame 30, and is disposed generally in a plane parallel to and beneath the sole of the boot when attached thereto, as best shown in FIG. 3. In the illustrated embodiment of FIGS. 2 and 3, the base plate 34 is generally rectangular in shape. The lateral side walls 36 and 40 and medial side walls 38 and 42 extend upwardly along the side of the base plate 34 to form rails along a portion of the lateral and medial sides of the boot to reduce movement of braking device 20 with respect to the boot B. Connected to the heel end side walls 40 and 42 is a generally U-shaped heel loop 44 positioned at the rearward end of the frame 30. The heel loop 44 rises above and rearward of the base plate 34 such that the heel loop 44 forms an opening between the heel loop 44 and the base plate 34. In one embodiment, the heel loop 44 may be a connecting strap known in the art that connects the frame 30 to the boot B at the heel end thereof. It will be appreciated that the frame 30 may include other features as well. For example, the bottom surface of the base plate 34 may be textured or formed with small bumps, ridges, or protrusions, to name a few, for providing traction for the sledder when walking across the snow layer S.

One non-limiting example of a boot B suitable for use with the braking device 20 is shown in FIG. 3. The boot B includes an sole O disposed at the bottom of the boot B and a substantially non-rigid upper U attached thereto for receiving and surrounding a sledder's foot and ankle. As was discussed above, other boots, such as snow boots, snowboard boots, or ski boots, to name a few, may be used with the braking device 20.

As best shown in FIGS. 2 and 3, the braking device 20 further includes boot retaining mechanisms in the form an ankle strap 48 and a toe strap 50 for securing the frame 30 to the sledder's boot B. The straps 48 and 50 may be any adjustable or non-adjustable straps of the conventional type typically used with snowboard bindings. The ankle strap 48 extends across the frame 30, forward of the heel loop 44. The ankle strap 48 is positioned above and in front of the junction of the instep and the anterior ankle area of the sledder's boot, and functions to hold the heel of the boot in place on the frame 30. The toe strap 50 is positioned above the toe end of the sledder's boot and functions to secure the forward or toe end of the boot to the frame 30.

Still referring to FIGS. 2 and 3, the braking device 20 further includes a braking member 60 rotatably coupled to the frame 30. Similar to the frame 30, the braking device may be formed from any suitable rigid material, such as aluminum, titanium, or other metals and alloys, engineering thermoplastics, and fiber reinforced thermoplastics or thermosetting polymers. In the embodiment shown, the braking member 60 is generally U-shaped having two spaced apart leg members 64 and 66 interconnected by a cross member or blade 70 at one end of the leg members 64 and 66. The other ends of the leg members 64 and 66 are rotatably connected about pivots 74 and 76 to the toe end side walls 36 and 38 of the frame 30, respectively. The pivots 74 and 76 may be formed by any suitable mechanical structure, such as rivets, pivot pins, or bolt fasteners, to name a few. The blade 70 defines an engagement edge 80, a substantial planar braking surface 84, and an optional slanted trailing edge 88, if desired.

While the braking member 60 is shown and described as U-shaped, it will be appreciated that other shapes may be used. For example, the blade 70 may be attached to the frame 30 through only one leg member, either leg member 64 or 66, such that the braking member is substantially L-shaped.

As best shown in FIG. 3, the braking member 60 is selectively movable about the pivots 74 and 76 between a pre-selected non-braking position (shown in phantom), and at least one pre-selected braking position. In the braking position, the braking member 60: 1) extends outwardly from the bottom of the frame 30; 2) the engagement edge 80 of the blade 70 is forward or distal of the toe end of the frame, and preferably, forward or distal of the toe end of the boot B when the frame 30 is attached thereto; and 3) the blade 70 is oriented at a selected angle 92 formed between the braking surface 84 and the sole of the boot (or the bottom surface of the sledder's foot when secured to the frame through boot B) such that the engagement edge 80 is the forward or distal edge of the blade 70 and the optional trailing edge 88 is the rear or proximal edge of the blade 70. In the non-braking position, the braking member 60 may be positioned such that the blade 70 is disposed above the plane of the base plate 34. It will be appreciated that the braking member 60 may have any one of a number of non-braking positions as long as the braking member 60 does not substantially interfere with the sledder's ability to walk over various terrain, such as parking lots, indoor facilities, etc., when the braking member 60 is in the non-braking position.

To provide for selective rotational adjustment, the braking device 20 may include an indexing mechanism. The indexing mechanism permits the braking member 60 to be selectively adjustable between at least two pre-selected, fixed positions. In the embodiment shown, the indexing mechanism includes a detent 98 formed or otherwise attached to each leg members 64 and 66. The detents 98 are positioned proximal the pivot connection and project inward toward the toe end side walls 36 and 38. The indexing mechanism further includes apertures 102 and 104 (See FIG. 2) disposed in the toe and side walls 36 and 38. The detents 98 are configured to be cooperatively inserted into apertures 102 and 104 as the braking member 60 rotates between the non-braking and braking positions. As such, the positions of the apertures 102 and 104 determine the non-braking and braking positions, respectively. It will be appreciated that a plurality of apertures 104A–104C may be disposed in the side walls 36–38 to provide a plurality of braking positions, if desired. In operation, when sufficient force is applied, the detents 98 are forced to withdraw from its corresponding aperture due to the size and configuration of the detents, thereby allowing free rotation of the braking member 60. In one embodiment, this action is possible due to the movement of the toe end sidewalls 36 and 38 with respect to the leg members 64 and 66, respectively.

While detents and apertures were utilized in the embodiment described above and illustrated herein, other indexing mechanisms may be employed for providing a selectively positionable braking member 60. For example, instead of a fixed detent, a spring-biased pin, or a manually insertable pin may be used. Additionally, if pivot pins are utilized as the pivots 74 and 76, they may be configured with quick release locking cam devices, similar to those used in the bicycle arts to retain bicycle wheels to the front and rear forks, that press the side walls 36 and 38 against the leg members 64 and 66, respectively, thereby prohibiting rotational movement of the braking member 60 absent a sufficient applied force. Further, the apertures 102 and 104 may be internally threaded and the detents 98 replaced with apertures for receiving a cooperating threaded fastener, such as a screw, when the respective apertures are aligned.

In addition to the indexing mechanism, the braking device 20 may also include mechanical limit stops that define the end positions of the travel path of the rotating braking member 60. The end positions determined by the limit stops may or may not coincide with the non-braking and braking positions described above. In the embodiment shown, the limit stops are formed by an arcuate slot 110 disposed in at least one of the leg members (shown as leg 64 in FIG. 3) of the braking member 60 and positioned radially outward of the pivot 74. The center point of the arcuate slot 110 is coaxial with the pivot 74. A stud or projection pin 112 is fixed to the outward facing surface of the corresponding toe end side wall (shown as toe end side wall 36 in FIG. 3) in such a position as to project through the slot 110. The pin 112 is dimensioned to slide along the slot 110 as the braking member 60 is rotated about pivots 74 and 76. As such, the braking member 60 rotates clockwise or counter-clockwise until the pin 112 contacts the respective end of the slot 110, inhibiting further braking member rotation. In the embodiment shown, the clockwise rotational limit stop (as shown in FIG. 3) corresponds to the braking position.

In accordance with an aspect of the present invention, the selected angle 92 formed in the braking positions between the braking surface 84 of the blade 70 and the plane of the sole has a value such that the engagement edge 80 penetrates into the snow and creates a sufficient braking force against the braking surface 84 to adequately brake the forward motion of the sled. It is believed by the inventors of the present invention that when the angle 92 is between 35 and 55 degrees, and preferably 45 degrees, the engagement edge 80 penetrates into the surface of the snow automatically by the forward motion of the sled, and continues to penetrate deeper into the snow layer as a result of the snow layer colliding with the braking surface 84. The continuing penetration or "anchoring action" of the braking member creates a braking force on the braking surface 84 that is sufficient to slow or stop the forward motion of the sled.

The operation of the braking device 20 will now be described with reference to FIGS. 1–3. The braking device 20 may be selectively coupled to the sledder's boot B by first placing the boot sole O in contact with the base plate 34 with the heel end of the boot pressed against the heel loop 44. Once the boot B is in such a position, the ankle and toe straps 48 and 50 may be selectively secured around the boot B. When the sledder R wishes to traverse the snow covered terrain by walking or riding on a chairlift, for instance, to the top of a hill, the braking member 60 may be fixed in the non-braking position or "walking position" so as to not drag or interfere with the surface below the boot B. Once at the top of the hill, when the sledder R wishes to traverse snow covered terrain on a sled in a typical sledding position (the rider being in a prone position facing the snow covered terrain with their feet trailing the sled), the sledder rotates the braking member 60 from the non-braking position to one of the braking positions, if equipped with multiple braking positions, by applying a sufficient rotational force against the engagement edge 80 of the braking member 60. The application of a sufficient rotational force against the braking member 60 causes the detents 98 to disengage or withdraw from the apertures 102, allowing free rotation of the braking member 60. The braking member 60 may continue to freely rotate until the detents 98 engage with one of the apertures 104A–104C corresponding to the desired braking position. By providing multiple braking positions, the sledder can select the desired amount of braking, which may depend upon the snow conditions of the hill or other variables, such as the grade of the slope.

Once the braking member 60 is in the desired braking position, the sledder may begin traversing the snow layer on the sled V. As the sledder R traverses the snow layer S, the sledder may extend their legs L parallel to the snow layer S, and drag their feet causing the engagement edge 80 of the braking member 60 to engage the snow layer S at an angle such that the blade 70 digs into the snow layer S. As the engagement edge 80 digs into the snow layer S, a braking force is produced against the braking surface 84 as the braking member 60 anchors into the snow layer, thereby slowing or stopping the forward motion of the sled V. It will be appreciated that the braking member 60 also creates a rooster tail of snow as the braking member travels through the snow to provide a visual that other participants traversing the snow layer behind the sledder R, such as other sledders, skiers and snowboarders, can see.

Figure 4:
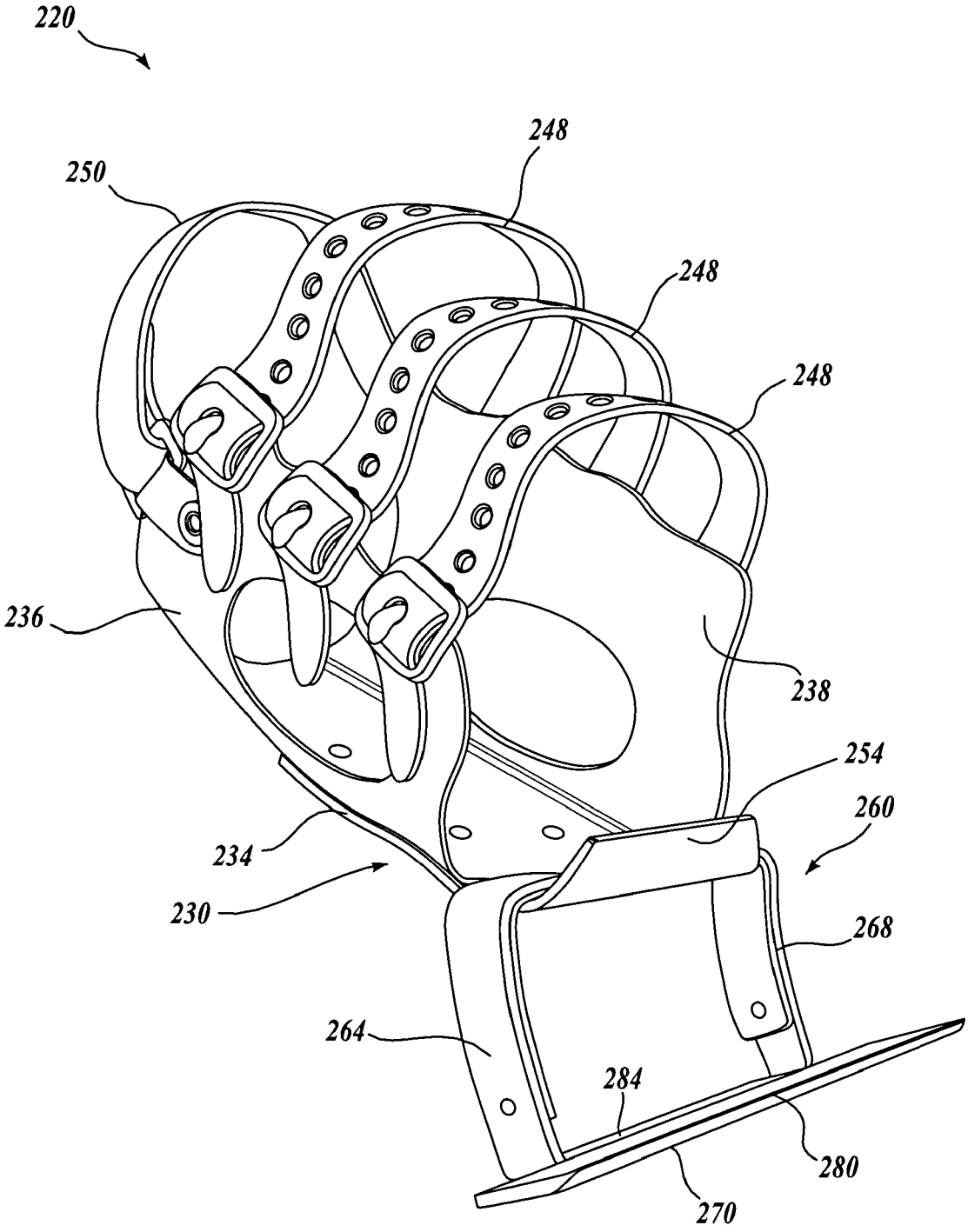
FIG. 4 is a perspective view of another embodiment of a braking device constructed in accordance with the present invention.

Referring now to FIG. 4, another embodiment of a braking device 220 constructed in accordance with the present invention is shown. The braking device 220 includes frame 230 and a braking member 260. The frame 230 comprises a rigid base plate 234 to which flexible side walls 236 and 238 are attached. The side walls 236 and 238 extend up from the edges of the base plate 234 on the sides of the boot when attached thereto. Suitable materials used to construct the base plate may include aluminum, titanium, or other metals and alloys, engineering thermoplastics, and fiber reinforced thermoplastics or thermosetting polymers, while suitable materials use to construct the side walls 236 and 238 may include canvas, leather, rubber, or nylon, to name a few. The frame 230 further includes boot retaining mechanisms in the form of straps 248 for securing the sledder's boot to the base plate 234. The straps 248 extend over the instep of the boot and fasten to the other side wall via buckles known in the art. In the embodiment shown, a heel strap 250 is also provided. In an alternative embodiment, the base plate 234 may be connected to the bottom surface of a flexible sleeve or overshoe, which may be slipped over the boot of the sledder for attaching the base plate 234 to the boot. The base plate 234 may optionally include an upturned toe stop flange 254 for engaging the front of the boot when attached thereto.

The braking device 220 further includes a braking member 260. The braking member 260 may be constructed from suitable materials, such as aluminum, titanium, or other metals and alloys, engineering thermoplastics, and fiber reinforced thermoplastics or thermosetting polymers. In the embodiment shown, the braking member 260 is generally U-shaped having two spaced apart leg members 264 and 268 interconnected by a cross member or blade 270 at one end of the leg members 264 and 268. The blade 270 defines an engagement edge 280 and a substantial planar braking surface 284. The braking member 260 is rigidly connected to the base plate 234 at the ends of the leg members 264 and 268 opposite the blade 270 in the braking position, that is, such that the blade 270 is positioned forward and below the base plate 234, and an angle (not shown) is formed between the plane of the base plate 234 and the plane of the braking surface 284. As was described above with respect to the embodiment of FIGS. 2 and 3, the angle formed between the braking surface 284 and the plane of the boot sole when the braking device 220 is attached thereto is in the range of between about 35 and 55 degrees, and preferably, about 45 degrees.

While the braking member 260 is shown and described as U-shaped, it will be appreciated that other shapes may be used. For example, the blade 270 may be attached to the base plate 234 through one leg member, either leg member 264 or 268, such that the braking member 260 is substantially L-shaped. Alternatively, the single leg member 264 or 268 may be attached to the blade 270 at its middle region and connected to the toe stop flange 254 such that the braking member 260 is substantially T-shaped.

Figure 5:
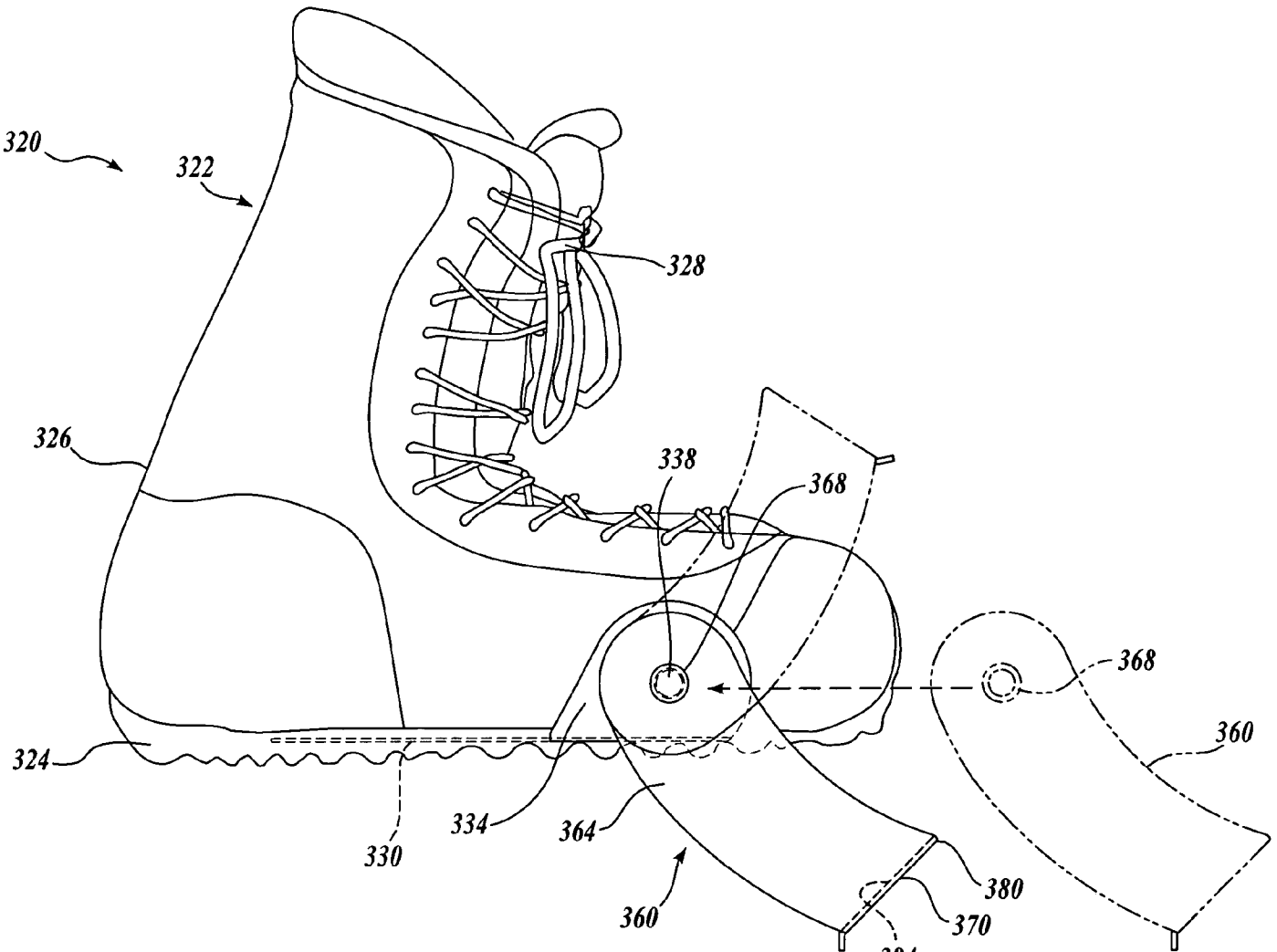
FIG. 5 is a side elevational view of another embodiment of a braking device constructed in accordance with the present invention.

FIG. 5 is a side elevational view of another embodiment of a braking device 320 constructed in accordance with the present invention. The braking device 320 is a sled brake boot that includes an sole 324 disposed at the bottom of the boot 322 and an upper 326 attached thereto for receiving and surrounding a sledder's foot and ankle. The upper 326 is preferably non-rigid and may be suitably constructed from flexible materials such as fabric, leather, flexible plastics, and cushioning materials such as fiber fleece, batting or elastomeric foams. The sole 324 is preferably constructed from a soft, flexible material so as to provide comfort and walkability. In the embodiment shown, the upper 326 extends past the ankle region; however, the boot upper 326 may terminate below the ankle, if desired. The boot 322 further includes laces 328 or other tightening mechanisms for tightening the upper 326 around the sledder's foot. In an alternative embodiment, the upper 326 and sole 324 may be substantially rigid like a conventional ski boot.

A frame structure 330 is either embedded into the sole 324 (as shown) or is fixedly attached to the bottom surface of the sole 324 by methods known in the art, such as adhesive bonding or molded in as part of the sole. The frame structure 330 includes toe end medial and lateral side walls 334 (the medial side wall is hidden in FIG. 5). The braking device 320 further includes a braking member 360 removably coupled to the frame structure 330 at the toe end medial and lateral side walls 334. In the embodiment shown, the braking member 360 is generally U-shaped having two spaced apart leg members 364 (only one leg member is shown) interconnected by a cross member or blade 370 at one end of the leg members 364. The blade 370 defines an engagement edge 380 and a substantial planar braking surface 384. The braking member 360 is removably connected to the frame structure 330 at the ends of the leg members 364 opposite the blade 370.

The braking member 360 may be removably connected to the frame structure 330 in a variety of suitable methods. For example, as shown in FIG. 5, the leg members 364 may include apertures 368 that cooperatively receive hubs 338 formed integrally with or connected to the side walls 334. Clamps or retainment pins (not shown) may optionally be attached at the end region of the hubs 338 to securely fasten the braking member 360 to the frame structure 330, if desired. Alternatively, the side walls 334 may include slots or apertures that receive hubs formed at the end region of the leg members 364.

In either case, the braking member 360 may be rigidly attached to the boot in the braking position, or may be rotatably attached to the boot. In the rotatably attachable embodiments, the braking device may further include a suitable mechanism for providing a selective fixed walking position and a selective fixed braking position. In the rigidly attachable embodiments, the hub may be keyed within the receiving apertures for prohibiting rotation. The keying structure may also be utilized to provide a fixed braking position, and a separate fixed non-braking position (e.g. to change from the braking position to a non-braking position and vice versa, the braking member is first separated from the frame structure and then rotated in a suitable direction until the aperture accepts the hubs in the desired position). It will also be appreciated that additional structures, such as notches, may be included to establish multiple braking positions.

When the breaking member 360 is in the braking position, an angle (not shown) is formed between the boot sole 324 (or the plane of the bottom surface of the sledder's foot) and the braking surface 384. As was described above with respect to the embodiment of FIGS. 2–3 and 4, the angle (not shown) is in the range of between about 35 and 55 degrees, and preferably, about 45 degrees. The frame structure 330 and the brake member 360 may be constructed from suitable materials, such as aluminum, titanium, or other metals and alloys, engineering thermoplastics, and fiber reinforced thermoplastics or thermosetting polymers.

While exemplary embodiments of the invention have been illustrated and described, it will be appreciated that various changes can be made therein without departing from the spirit and scope of the invention. For example, while in one embodiment, the frame is mounted to the underside of the sledder's boot, it will be appreciated that the frame may be configured to be removably connected to the boot in other positions, such as on the top or arch portion of the boot.

The embodiments of the invention in which an exclusive property or privilege is claimed are defined as follows:

1. A braking device selectively attachable to a boot of a rider having a sole, the braking device for use with a surface traversing apparatus on which a rider is mounted in a prone position, comprising:

a base configured to be selectively attachable to a boot of the rider, wherein the base defines a toe end; and a braking member defining a substantially planar braking surface, the braking member being coupled to the base and selectively moveable between a first position, wherein a portion of the braking member extends distally past the toe end of the base and the substantially planar braking surface of the braking member is oriented below the boot sole at a selected acute angle with respect to the sole of the boot when the base is attached thereto, and at least one second position.

2. The device of claim 1, wherein the base includes a substantially planar top surface for contacting the sole of the rider's boot.

3. The device of claim 1, wherein the braking member is rigidly coupled to the base.

4. The device of claim 1, wherein the braking member is rotatably coupled to the base and is selectively moveable between the first position at least one second position.

5. The device of claim 4, wherein the braking surface is positioned below the plane of the boot sole when the braking member is attached to the boot.

6. The device of claim 1, wherein the braking member includes at least one leg member coupled to the base and a blade connected to the leg member, the blade defining the braking surface.

7. The device of claim 6, wherein the braking member is substantially U-shaped having two spaced apart leg members interconnected by the blade.

8. The device of claim 1, wherein the braking surface is substantially planar.

9. The device of claim 1, wherein the acute angle formed between the sole of the boot and the braking surface is between 35 degrees and 55 degrees when the braking member is attached to the boot.

10. A sled braking device comprising:

a boot including a sole and defining a heel and toe end; and a braking member defining a substantially planar braking surface, the braking member coupled to the boot and selectively moveable between a first position, wherein a portion of the braking surface extending distally past the toe end of the boot and the substantially planar braking surface of the braking member is oriented below the sole of the boot at a selected acute angle with respect to the sole of the boot, and at least one second position.

11. The sled device of claim 10, wherein the braking member is removably coupled to the boot.

12. The sled device of claim 10, wherein the braking member is pivotally coupled to the boot, the braking member being selectively moveable between the first position and a second position.

13. The sled device of claim 12, further including an indexing mechanism, the braking member selectively moveable between the first position and the second position by the indexing mechanism.

14. A braking device for use with a sled comprising:

a boot including a sole and having toe and heel ends;

a braking member coupled to the boot said breaking member defining an engagement edge and a substantially planar braking surface, the engagement edge being positioned forward the toe end of the boot and the substantially planar braking surface moveable below the sole of the boot at a selected acute angle with respect to the sole of the boot; and means for attaching the braking member to the boot.

15. The device of claim 14, wherein the attachment means includes means for rotatably attaching the braking member to the boot.

16. The device of claim 15, further including indexing means for selectively positioning the braking member between at least two positions.

17. A braking device selectively connectable to a rider's boot, comprising:

a base having a toe end and a heel end, the base being adapted to support a sole of the rider's boot;

at least one boot securement member attached to the base; and a substantially planar braking surface, a portion of the braking surface positioned forward of the toe end of the base and moveable below the boot sole at an angle with respect to the boot sole when the boot is attached to the base, the angle formed between the boot sole and the braking surface being between about 35 degrees and about 55 degrees.

18. A braking device selectively connectable to a sledder's boot, the boot having a sole that defines a plane substantially parallel to the bottom of the sledder's foot when coupled thereto, the braking device comprising:

a frame structure;

at least one boot securement member attached to the frame structure; and a braking member defining a substantially planar braking surface, the braking member rotatably connected to the frame structure, the braking member being movable along a path of travel between at least two positions, one of the positions being a braking position whereby the substantially planar braking surface is located distal of the frame structure below the boot sole and is oriented at an angle of approximately 35 degrees to 55 degrees with respect to the plane of the boot sole when the braking device is connected to the sledder's boot.

19. The braking device of claim 18, further including braking member rotational limit stops.

* * * * *

UNITED STATES PATENT AND TRADEMARK OFFICE

CERTIFICATE OF CORRECTION

PATENT NO. : 7,024,804 B2
APPLICATION NO. : 10/713610
DATED : April 11, 2006
INVENTOR(S) : D.E. Levy et al.

It is certified that error appears in the above-identified patent and that said Letters Patent is hereby corrected as shown below:

| COLUMN | LINE | ERROR |
|---|---|---|
| On Title Page (item 56) Pg. 1, col. 1 | Primary Examiner | "Kayanaugh" should read --Kavanaugh-- |
| 8 (Claim 4, | 67 line 3) | "position at" should read --position and at-- |
| 9 (Claim 14, | 41 line 3) | "boot said" should read --boot, said-- |
| 10 (Claim 17, | 18 line 8) | "braking surface positioned" should read --substantially planar braking surface positioned-- |

Signed and Sealed this

Twenty-eighth Day of November, 2006

JON W. DUDAS
*Director of the United States Patent and Trademark Office*